US008339235B2

(12) United States Patent
Beckert et al.

(10) Patent No.: US 8,339,235 B2
(45) Date of Patent: Dec. 25, 2012

(54) HOUSING SECURING APPARATUS FOR ELECTRICAL COMPONENTS, ESPECIALLY FUSES

(76) Inventors: James J. Beckert, Rolling Meadows, IL (US); Stephen R. Shierry, Villa Park, IL (US)

( * ) Notice: Subject to any disclaimer, the term of this patent is extended or adjusted under 35 U.S.C. 154(b) by 0 days.

(21) Appl. No.: 12/186,917

(22) Filed: Aug. 6, 2008

(65) Prior Publication Data

US 2010/0033291 A1 Feb. 11, 2010

(51) Int. Cl.
*H01H 85/02* (2006.01)

(52) U.S. Cl. ..... 337/198; 337/186; 337/159; 337/201

(58) Field of Classification Search ..... 337/198, 337/186, 159, 201
See application file for complete search history.

(56) References Cited

U.S. PATENT DOCUMENTS

| | | | |
|---|---|---|---|
| 33,137 | A | 8/1861 | Fletcher |
| 2,649,522 | A | 8/1953 | Marcus |
| 2,774,951 | A | 12/1956 | Kinkaid et al. |
| 2,903,539 | A | 9/1959 | Matthysse et al. |
| 2,921,287 | A | 1/1960 | Matthysse et al. |
| 2,996,026 | A | 8/1961 | Batcheller |
| 3,139,318 | A | 6/1964 | Binder et al. |
| 3,148,257 | A | 9/1964 | Feenan et al. |
| 3,288,968 | A | 11/1966 | Feenan et al. |
| 3,409,867 | A | 11/1968 | Lessner |
| 3,524,157 | A | 8/1970 | Salzer |
| 3,550,069 | A | 12/1970 | Teagno |
| 3,634,804 | A | 1/1972 | Mineo |
| 3,675,282 | A | 7/1972 | Summers et al. |
| 3,813,626 | A | 5/1974 | Cetola et al. |
| 3,872,416 | A | 3/1975 | Kinasi |
| 3,878,497 | A | 4/1975 | Spangler |
| 3,995,929 | A | 12/1976 | Ghirardi et al. |
| 4,099,320 | A | 7/1978 | Schmidt, Jr. et al. |
| 4,131,869 | A | 12/1978 | Schmidt, Jr. et al. |
| 4,164,725 | A | 8/1979 | Wiebe |
| 4,196,409 | A | 4/1980 | Juba |
| 4,253,080 | A | 2/1981 | Howard |
| 4,297,666 | A | 10/1981 | Asdollahi |
| 4,310,719 | A | 1/1982 | Cross et al. |
| 4,319,213 | A | 3/1982 | Reid |
| 4,344,060 | A | 8/1982 | Ciesemier et al. |

(Continued)

FOREIGN PATENT DOCUMENTS

DE 1615002 5/1970

(Continued)

OTHER PUBLICATIONS

US 4,430,633 (withdrawn).

*Primary Examiner* — Anatoly Vortman

(57) ABSTRACT

An electric component includes: an insulating housing; a conductive member inserted into the housing until hitting a stop provided by the housing, the conductive member configured to mate with a conductive portion of a device that mates with the electrical component, the mating device thereby applying a force to the conductive portion, the conductive member including a wall, the wall defining a projection that is at least substantially coplanar with the wall; and wherein the housing includes a catch that flexes when the conductive member is inserted into the housing to allow the projection to move past the catch so that the conductive member can hit the stop, at which point the catch unflexes into locking engagement with the projection.

18 Claims, 5 Drawing Sheets

U.S. PATENT DOCUMENTS

| | | | | | |
|---|---|---|---|---|---|
| 4,365,226 | A | | 12/1982 | Barry et al. | |
| 4,417,225 | A | | 11/1983 | Muller et al. | |
| 4,448,468 | A | | 5/1984 | Coldren | |
| 4,451,109 | A | | 5/1984 | Inoue | |
| 4,544,907 | A | | 10/1985 | Takano | |
| 4,553,808 | A | | 11/1985 | Weidler et al. | |
| 4,556,274 | A | | 12/1985 | Olivera | |
| 4,570,147 | A | | 2/1986 | Ebi | |
| 4,604,602 | A | | 8/1986 | Borzoni | |
| 4,612,529 | A | | 9/1986 | Gurevich et al. | |
| 4,635,023 | A | | 1/1987 | Oh | |
| 4,646,052 | A | | 2/1987 | Matsunaga et al. | |
| 4,661,793 | A | | 4/1987 | Borzoni | |
| 4,670,729 | A | | 6/1987 | Oh | |
| 4,672,352 | A | | 6/1987 | Takano | |
| 4,685,754 | A | | 8/1987 | Coldren | |
| 4,691,981 | A | | 9/1987 | Coldren | |
| 4,751,490 | A | | 6/1988 | Hatagishi | |
| 4,764,133 | A | | 8/1988 | Kaneko | |
| 4,781,628 | A | | 11/1988 | Detter et al. | |
| 4,800,358 | A | | 1/1989 | Takenouchi et al. | |
| 4,842,534 | A | | 6/1989 | Mobley et al. | |
| 4,869,972 | A | | 9/1989 | Hatagishi | |
| 4,871,990 | A | | 10/1989 | Ikeda et al. | |
| 4,958,426 | A | | 9/1990 | Endo et al. | |
| 4,975,551 | A | | 12/1990 | Syvertson | |
| 4,988,969 | A | | 1/1991 | Gurevich | |
| 4,992,062 | A | | 2/1991 | Nakayama et al. | |
| 4,994,084 | A | | 2/1991 | Brennan | |
| 4,994,697 | A | | 2/1991 | Santandrea | |
| 5,049,095 | A | | 9/1991 | Gugelmeyer | |
| 5,091,712 | A | | 2/1992 | Suuronen | |
| 5,106,324 | A | | 4/1992 | Natsume | |
| 5,137,473 | A | | 8/1992 | Nickola | |
| 5,139,443 | A | | 8/1992 | Armando | |
| 5,147,230 | A | | 9/1992 | Plyler et al. | |
| 5,181,866 | A | | 1/1993 | Jerome et al. | |
| 5,229,739 | A | | 7/1993 | Oh et al. | |
| 5,262,751 | A | | 11/1993 | Kudo et al. | |
| 5,281,175 | A | | 1/1994 | Chupak et al. | |
| 5,293,147 | A | | 3/1994 | Oh et al. | |
| 5,294,906 | A | | 3/1994 | Totsuka et al. | |
| 5,346,411 | A | | 9/1994 | Nikkinen | |
| 5,350,321 | A | | 9/1994 | Takenouchi | |
| 5,357,234 | A | | 10/1994 | Pimpis et al. | |
| 5,361,058 | A | | 11/1994 | Mosesian et al. | |
| 5,374,590 | A | | 12/1994 | Batdorf et al. | |
| 5,398,015 | A | | 3/1995 | Kudo et al. | |
| 5,416,461 | A | | 5/1995 | Totsuka et al. | |
| 5,488,346 | A | | 1/1996 | Kondo et al. | |
| 5,581,225 | A | | 12/1996 | Oh et al. | |
| 5,631,619 | A | | 5/1997 | Evans | |
| 5,668,521 | A | | 9/1997 | Oh | |
| 5,682,130 | A | | 10/1997 | Styrna et al. | |
| 5,736,920 | A | | 4/1998 | Evans et al. | |
| 5,739,739 | A | * | 4/1998 | Muramatsu et al. | 337/234 |
| 5,745,024 | A | | 4/1998 | Ohta et al. | |
| 5,781,094 | A | | 7/1998 | Nakamura et al. | |
| 5,818,321 | A | * | 10/1998 | Muramatsu et al. | 337/198 |
| 5,821,847 | A | * | 10/1998 | Totsuka | 337/166 |
| 5,825,274 | A | * | 10/1998 | Totsuka | 337/190 |
| 5,883,560 | A | * | 3/1999 | Nakamura et al. | 337/160 |
| 5,883,561 | A | * | 3/1999 | Nakamura et al. | 337/198 |
| 5,886,612 | A | | 3/1999 | Beckert et al. | |
| 5,889,458 | A | * | 3/1999 | Nakamura | 337/159 |
| 5,929,739 | A | * | 7/1999 | Totsuka | 337/198 |
| 5,929,740 | A | | 7/1999 | Oh et al. | |
| 5,963,122 | A | * | 10/1999 | Endo et al. | 337/198 |
| 6,144,283 | A | * | 11/2000 | Matsumura | 337/198 |
| 6,407,657 | B1 | | 6/2002 | Oh | |
| D461,781 | S | | 8/2002 | Fukumori et al. | |
| D462,061 | S | | 8/2002 | Fukumori et al. | |
| D462,331 | S | | 9/2002 | Fukumori et al. | |
| 6,445,563 | B1 | * | 9/2002 | Endo | 361/250 |
| 6,448,882 | B1 | * | 9/2002 | Inaba et al. | 337/227 |
| 6,456,188 | B1 | | 9/2002 | Tsuchiya | |
| 6,529,113 | B2 | | 3/2003 | Endo et al. | |
| 6,542,064 | B2 | | 4/2003 | Endo et al. | |
| 6,592,406 | B2 | | 7/2003 | Liu | |
| 6,824,430 | B2 | | 11/2004 | Matsumura et al. | |
| 6,828,896 | B2 | | 12/2004 | Ohashi et al. | |
| 2007/0054546 | A1 | * | 3/2007 | Higuchi | 439/500 |
| 2007/0066097 | A1 | * | 3/2007 | Higuchi | 439/76.2 |

FOREIGN PATENT DOCUMENTS

| | | | |
|---|---|---|---|
| DE | 2517069 | | 10/1976 |
| DE | 27 14 797 | | 2/1979 |
| DE | 43 40979 | A1 | 7/1994 |
| EP | 0228490 | A1 | 7/1987 |
| EP | 0463608 | A3 | 1/1992 |
| EP | 0633592 | A1 | 1/1995 |
| FR | 1312116 | | 12/1962 |
| FR | 1567727 | | 5/1969 |
| FR | 2557355 | | 6/1985 |
| GB | 858115 | | 1/1961 |
| GB | 2197759 | | 5/1988 |
| GB | 2228150 | | 8/1990 |
| JP | 57-210537 | | 12/1982 |
| JP | 59-16054 | | 1/1984 |
| JP | 59-178857 | | 11/1984 |
| JP | 60-177527 | | 9/1985 |
| JP | 61-61331 | | 3/1986 |
| JP | 61-240521 | | 10/1986 |
| JP | 61-271731 | | 12/1986 |
| JP | 61-294730 | | 12/1986 |
| JP | 64-60937 | | 3/1989 |
| JP | 1-241728 | | 9/1989 |
| JP | 1-241729 | | 9/1989 |
| JP | 1-315924 | | 12/1989 |
| JP | 2-66828 | | 3/1990 |
| JP | 2-89753 | | 7/1990 |
| JP | 2-199735 | | 8/1990 |
| JP | 5-172050 | | 6/1993 |
| JP | 5-205608 | | 8/1993 |
| JP | 5-274995 | | 10/1993 |
| JP | 6-13043 | | 2/1994 |
| JP | 6-48149 | | 6/1994 |

* cited by examiner

HOUSING SECURING APPARATUS FOR ELECTRICAL COMPONENTS, ESPECIALLY FUSES

BACKGROUND

The present disclosure relates generally to electrical components and in particular to fuses, such as automotive fuses.

Automobile and other female fuse assemblies commonly include a two-piece assembly having an insulating housing and an all metal one-piece female fuse secured therein. The female fuse has a pair of spaced apart female terminals that are accessible from one end of the housing, into which male terminals are inserted. The male blade-type terminals or conductors extend typically from a mounting panel or male fuse block. The female terminals are typically held tightly within walls of the insulating housing. The female fuse also includes a fuse element that extends between the female terminals. The width of the fuse element is typically narrowed to create a fuse opening portion for the fuse.

The terminals need to be inserted into the housing during manufacturing, requiring an opening on one end, which is then capped. The other end of the housing is open for engagement with the fuse block terminals. Once the housing is in position relative to the terminals, the terminals need to be restrained from moving any further in the insertion direction relative to the housing. Once the fuse opens it needs to be replaced. An operator pulls the opened fuse from the fuse block and replaces the opened fuse with a new fuse. The force needed to remove the fuse is not inconsequential given that the fuse needs to be secured under vibrating operating conditions. Likewise, the force needed to reinsert the new fuse is not inconsequential. Accordingly, an apparatus is needed that allows the terminal to be inserted into the housing in one (fuse insertion) direction but prevents the housing from being further moved in the fuse insertion direction relative to the housing once the terminals are in a desired position relative to the housing.

U.S. Pat. No. 5,929,740 ("the '740 Patent"), assigned to the assignee of the present disclosure, the entire contents of which are incorporated herein by reference, describes one such apparatus. FIGS. 1, 8 and 17 of the '740 Patent perhaps best show what are termed "lances" 132 and 134 that secure the housing to the fuse terminals. Beginning at column 8, line 66, the '740 Patent reads as follows:

For the purpose of securing the female fuse within main portion 106 of the housing 2, the first female terminal portion 6 includes a first lance 132. The first lance is defined by a first lance cutout portion 136 on the first face portion 10 of the first female terminal portion 6, and is substantially centered between the first and second ends 14, 18 of the first face portion 10 of the first female terminal portion 6. The first lance 132 includes a first lance edge 140. Likewise, the second female terminal portion 8 further includes a second lance 134. The second lance 134 is defined by a second lance cutout portion 138 on the second face portion 12 of the second female terminal portion 8, and is substantially centered between the first and second ends 16, 20 of the second face portion 12 of the second female terminal portion 8. The second lance 134 also has a second lance edge 142. When the female fuse 4 is inserted into the main portion 108 of the housing 2, the first lance edge locks into the first interior cutout portion 120, and engages with the first cutout upper wall 126. Likewise, the second lance edge 142 locks into the second interior cutout portion 122, and engages with the second cutout upper wall 130. The cap 108 of the housing 2 is preferably transparent, and locks into the main portion 108 through well known techniques.

The bent lances 132 and 143 have in certain cases caused problems due primarily to inconsistencies in the bending process. The lances 132 and 134 are quite small, making consistent bending somewhat problematic. If the lances 132 and 134 are not bent far enough, they will not engage the cutout walls 126 and 130 properly. If the lances 132 and 143 are overly bent, they lose too much force for resistance against the terminals being pushed up into the housing.

A need therefore exists for an improved fuse housing holder apparatus.

SUMMARY

The present disclosure addresses the above-described deficiency in the prior art. While fuses, such as female automotive fuses, provide one suitable application for the housing securing apparatus of the present disclosure, the apparatus can be applied in other electrical components, such as male blade and other types of fuses and fuse holders, circuit breakers, and electrical connectors. In one embodiment, the fuse or electrical component includes an insulating housing. A conductive member inserted into the housing until hitting a stop provided by the housing, wherein the conductive member is configured to mate with a conductive portion of a device that mates with the electrical component, the mating device thereby applying a force to the conductive portion. For example, the conductive member can include female terminals as shown in detail below, which mate with male terminals attached to a fuse block or other fuse center. The male terminals thereby apply a force, e.g., a spring-like clamping force that holds the fuse in place even under vibrating conditions. The present apparatus prevents the terminals from being pushed into the housing. The conductive member could alternatively include male blade-type terminals that mate with female terminals attached to the fuse block or center.

The conductive member includes a wall that can for example be a wall bridging the female terminals located at the bottom of the housing and a fuse element located at the top of the housing. The wall defines or provides a projection that is at least substantially coplanar with the wall. The housing includes an internal catch that flexes when the conductive member is inserted into the housing to allow the projection to move past the catch, so that the conductive member can hit the stop, at which point the catch unflexes or snaps back into locking engagement with the projection.

The conductive member in one embodiment includes first and second terminals (or terminal pairs as shown in detail below), such as first and second female terminals. The first and second female terminals each extend from first and second terminal bodies. The first and second terminal bodies in one embodiment are four-sided, each having a front wall, rear wall, inner wall and outer wall. The terminals in one embodiment extend from the inner and outer walls of the terminal bodies. The projection(s) is formed on one of the front or rear walls of the terminal body.

A fuse element extends between the terminal bodies, for example from the outer wall of the first body to the outer wall of the second body. The fuse element includes a fuse link located in one embodiment above the first and second bodies and in the approximate center of the fuse element. The fuse link is narrowed and provides a high resistance point at which the fuse opens. To this end, the fuse link can be provided with one or more spot of dissimilar, low melting temperature metal commonly termed a Metcalf spot, which aids in the opening of the fuse at the fuse link.

The stop and the catch of the housing fix the conductive member (e.g., including terminal bodies, fuse element and terminals) relative to the housing in both a (manufacturing and application) insertion direction and a direction opposite the insertion direction (e.g., opened fuse removal direction). During manufacture, the housing is initially open at its top. The conductive member is inserted into the housing and snap-fitted over the catch. The housing is then capped at its top end, that is, the end into which the conductive member is inserted into the housing before being capped. The housing is open at the opposite or bottom end, so that the fuse and housing can be inserted onto (or receive) the mating device. The mating device in one embodiment includes first and second male terminals that extend from a fuse block or fuse center. The first and second male terminals slip into the first and second female terminals (or terminal pairs) for operation.

As shown in detail below, the projection of the front or rear wall is formed by removing a section of the front or rear wall and in one embodiment a section of the front wall. The metal removal is done while the conductive member is in a flat or unbent condition, that is, before the flat is bent to form the terminal bodies having the inner, outer, front and back walls. The metal removal can be via a process selected from the group consisting of: (i) stamping; (ii) laser cutting; and (iii) wire electrical discharge machining ("EDM"). After the metal sections are removed, the projection can have a shape that is at least one of: pointed, trapezoidal and triangular.

As shown below, the projection in one embodiment includes a lower or engaging edge that engages the catch as the conductive member is inserted into the housing. The engaging edge is angled so as to gradually and increasingly flex the catch as the conductive member moves along the catch. For example, the engaging edge can have an angle of about forty-five degrees relative to a horizontal line (parallel to cap or top of the housing).

The projection can also include an upper or catching edge that comes into locking engagement with the housing, the catching edge can also be angled so as to have a directional component that opposes an insertion direction of the conductive member into the insulating housing. In this manner, the catching edge knifes up into a mating surface of the (catch of the) housing, preventing further movement of the housing in the (manufacturing and application) insertion direction relative to the conductive member.

In one embodiment, the mating surface is also angled, so as to mate with the angle of the catching or upper edge of the projection. The angle of the catching or upper edge of the projection is in one embodiment less severe (e.g., thirty degrees relative to a horizontal line) than the angle of the engaging edge of the projection, so that the projection forms a somewhat pointed, triangular or trapezoidal shape for projecting upward into the mating surface of the housing.

As seen below, the front or rear (projection) walls of the terminal bodies are bent along bendlines from the outer walls of the terminal bodies. The inner walls are bent along separate bendlines to for the box-like shape of the terminal bodies. A section of the bendline between the outer and front (or rear) wall can be removed at a top portion of the bendline (portion opposing the projection), so that the upper portion of the front or rear (projection) wall can flex or bend slightly as the projection is pulled over the catch of the housing. Such flexing or bending in combination with the flexing of the catch helps to produce the snap-fit of the housing onto the conductive member.

As mentioned above, the conductive member in one embodiment includes first and second terminal bodies, each having terminals extending downward from the bodies (to mate with separate, e.g., male terminals of a fuse box). Each of the bodies provides a projection, in which the projection is preferably formed from and thus at least substantially coplanar with one of the walls of the body. The catch flexes to accommodate each projection. Or, first and second catches are provided individually for the first and second projections so that the first and second catches can flex individually. In either case, to distribute the forces applied by the projections, the first and second projections can be: (i) disposed relative to each other so as to be adjacent to opposing sides of the housing and (ii) disposed relative to each other so as to be adjacent to diagonally spaced apart corners of the housing. It is also contemplated to form multiple projections on the same terminal body, e.g., one on the front wall and one on the rear wall of the terminal body.

It is accordingly an advantage of the present disclosure to provide an electric component including an insulating housing; a conductive member inserted into the housing and configured to mate with a conductive portion of a device that mates with the electrical component, the conductive member including a wall, the wall cut to form a projection that is at least substantially coplanar with the wall; and wherein the housing includes a catch that flexes when the conductive member is inserted into the housing to allow the projection to move past the catch, at which point the catch snaps into locking engagement with the projection.

It is another advantage of the present disclosure to provide an electric component including: an insulating housing; and a conductive member inserted into the housing and configured to mate with a conductive portion of a device that mates with the electrical component, the conductive member including a wall, the wall defining a projection that is at least substantially coplanar with the wall and that has an engaging edge angled so as to gradually and increasingly engage a portion of the housing as the conductive member is inserted into the housing, the projection eventually moving into locking engagement with the housing.

It is a further advantage of the present disclosure to provide an electric component including: an insulating housing; and a conductive member inserted into the housing and configured to mate with a conductive portion of a device that mates with the electrical component, the conductive member including a wall, the wall defining a projection that is at least substantially coplanar with the wall and that engages a portion of the housing as the conductive member is inserted into the housing, wherein at least one of the projection and the engaged portion of the housing flexes to allow the projection move eventually into locking engagement with the housing.

Additional features and advantages are described herein, and will be apparent from the following Detailed Description and the figures.

DETAILED DESCRIPTION

Figure 1:
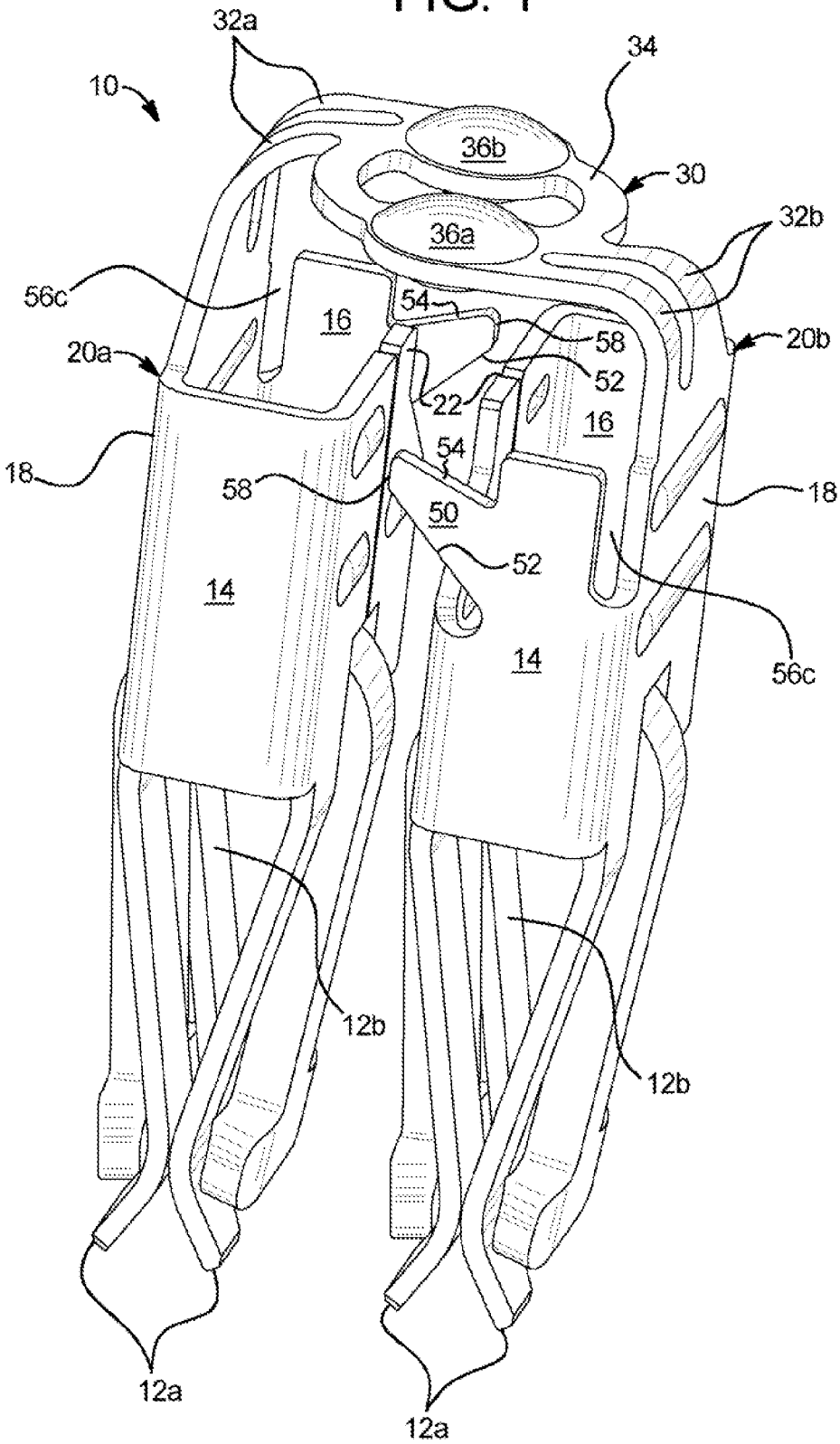
FIG. 1 is a perspective view of one embodiment of a conductive member having a portion of the housing securing apparatus of the present disclosure.
Figure 2:
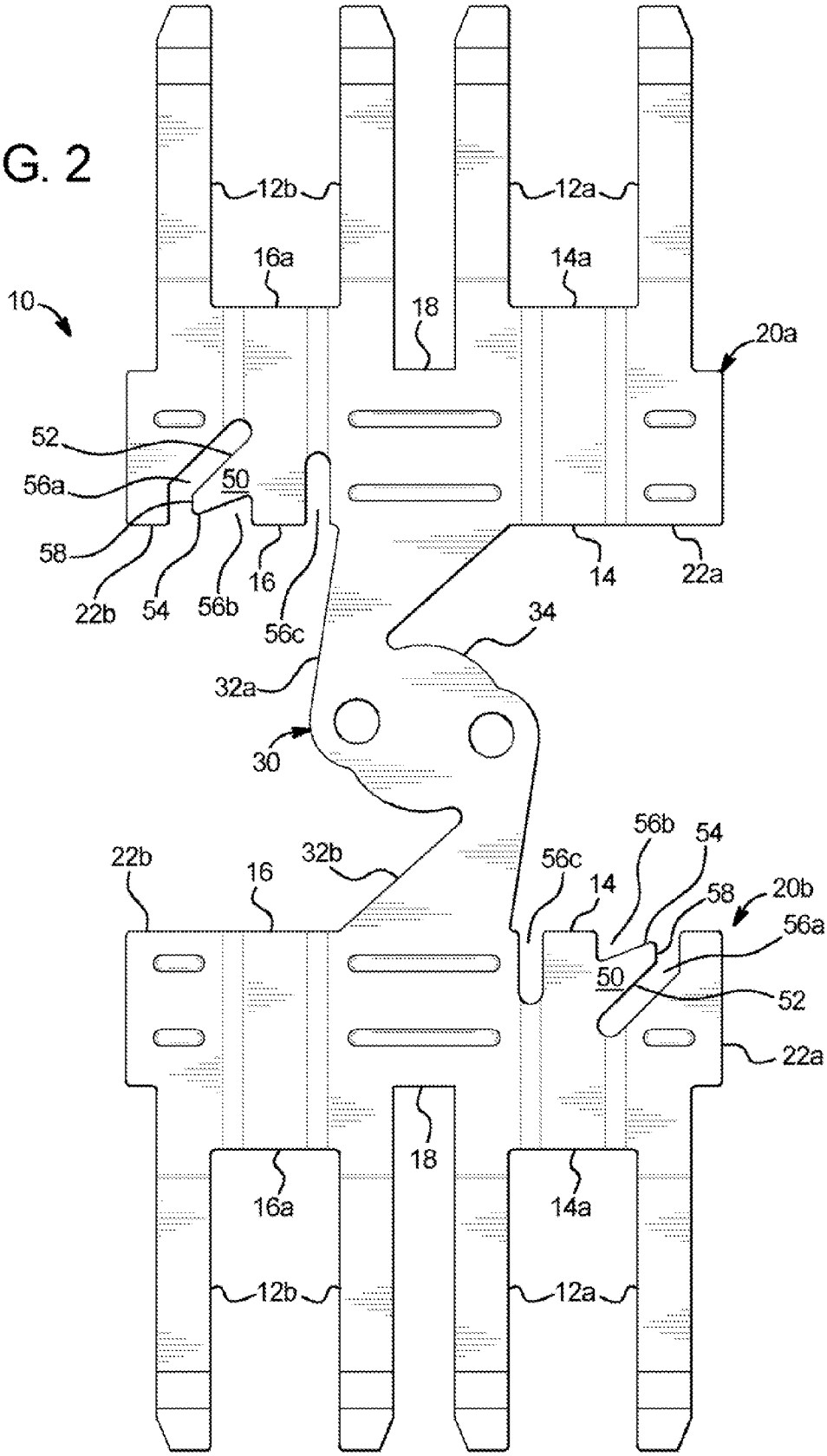
FIG. 2 is a plan view of one embodiment of the conductive member in a flat or pre-bent condition.
Figure 3:
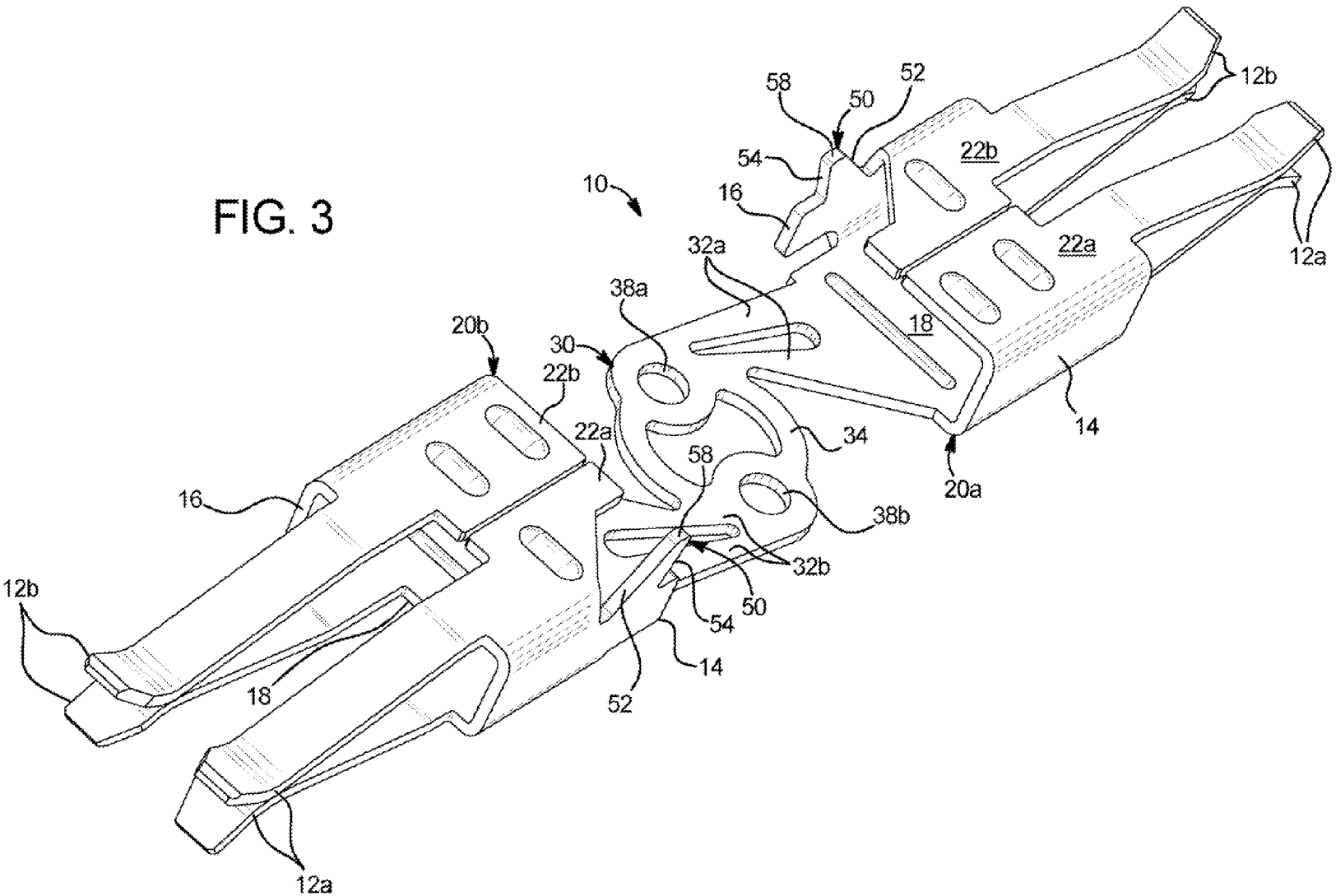
FIG. 3 is a perspective view of one embodiment of the conductive member in a partially bent or formed condition.

Referring now to the drawings and in particular to FIGS. 1 to 3, an embodiment of a conductive member 10 of an assembled electrical component (shown in FIGS. 4 and 5) is illustrated. Conductive member 10 includes terminal pairs 12*a* and 12*b* that extend from each of terminal bodies 20*a* and 20*b*. Terminal bodies 20*a* and 20*b* are connected together mechanically and electrically via a fuse element 30. Conductive member 10 is made of metal, such as copper, a copper alloy or plated copper. Terminal pairs 12*a* and 12*b* are illustrated as female terminals but can alternatively be male terminals of an automotive blade fuse for example. Conductive member 10 is used for a fuse in the illustrated embodiment but is alternatively a conductive member (having a different configuration) for a different type of electrical component, such as a fuse holder, circuit breaker or electrical connector.

Each of terminal bodies 20*a* and 20*b* includes a front wall 14, a rear wall 16, an outer wall 18 and an inner wall 22 (formed via first and second inner wall panels 22*a* and 22*b* as seen best in FIGS. 2 and 3). Front walls 14 and rear walls 16 are bent from outer walls 18. Inner wall panels 22*a* and 22*b* are bent from front walls 14 and rear walls 16, respectively, as seen best in FIG. 2.

Figure 4:
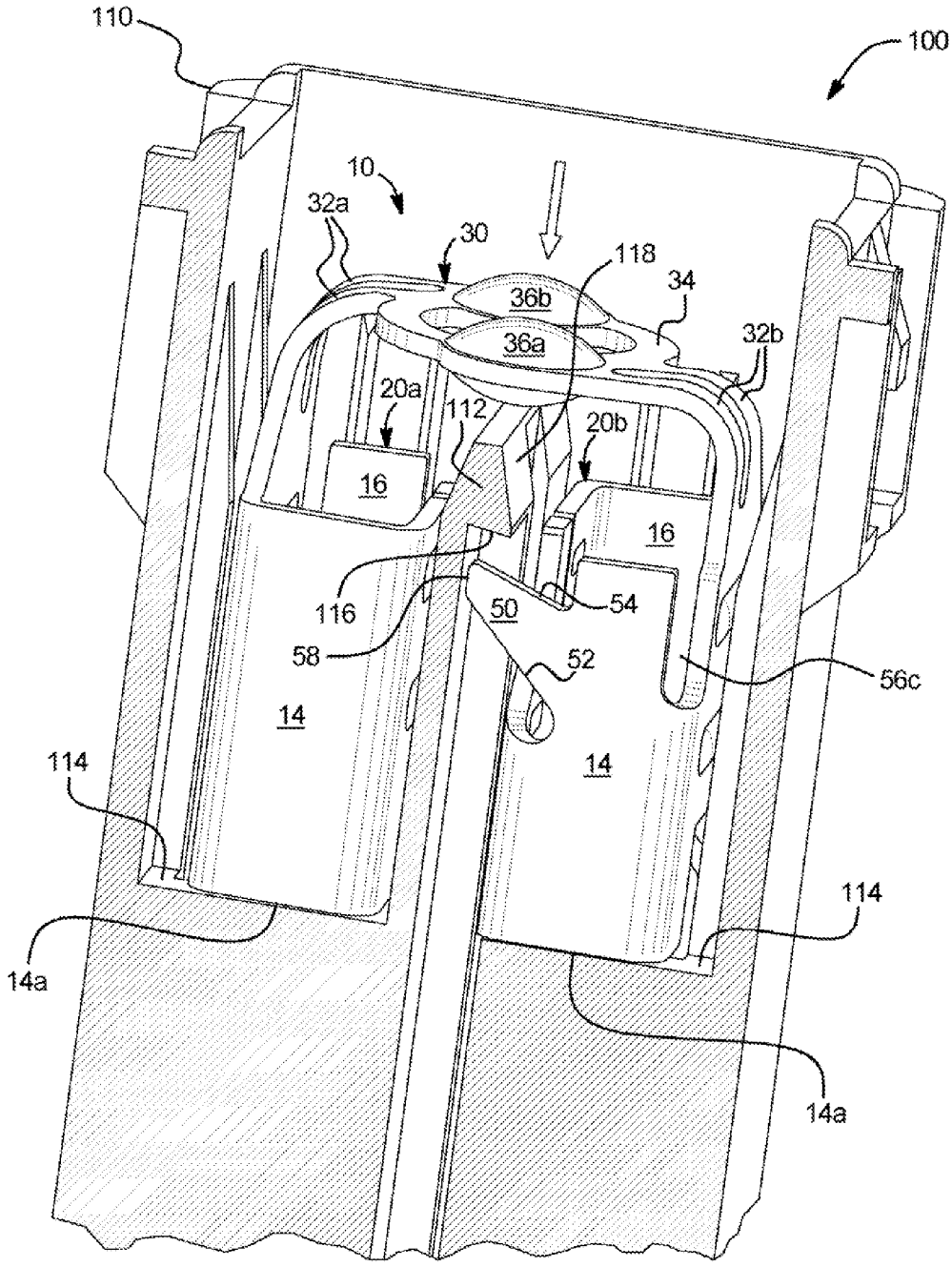
FIG. 4 is a perspective view of one embodiment of an electrical component having a securing apparatus of the present disclosure.

Fuse element 30 includes fuse element legs 32*a* and 32*b* (each leg can have multiple extensions as illustrated in FIGS. 1, 3 and 4 or only a single extension as seen in FIG. 2), which extend from terminal bodies 20*a* and 20*b*, respectively, to a single fuse link 34. The illustrated embodiment shows multiple fuse element legs 32*a* and 32*b* extending from outer walls 18 of the respective terminal bodies 20*a* and 20*b*.

Fuse link 34 forms a ring between legs 32*a* and 32*b*. Lower melting temperature (Metcalf) spots 36*a* and 36*b* are placed at desired areas of the ringed fuse link 34. FIG. 3 illustrates one embodiment in which apertures 38*a* and 38*b* are formed in the ring of fuse link 34. Metal spots 36*a* and 36*b* fill apertures 38*a* and 38*b*, respectively. Metal spots 36*a* and 36*b* can be made for example from tin or tin-alloy, which has a lower melting temperature than the, e.g., copper, ring. Spots 36*a* and 36*b* thereby melt more quickly and diffuse into the ring of link 34 surrounding apertures 38*a* and 38*b*, causing the ring to open at one of the spots 36*a* and 36*b* upon a fuse link opening event (e.g., short circuit or low overload event).

Projections 50 are formed during the cutting (e.g., stamping; (ii) laser cutting; or (iii) wire electrical discharge machining ("EDM")) and bending of conductive member 10. Each projection 50 includes an engaging edge 52 and a catching edge 54. Engaging edge 52 is formed at an angle, e.g., from about forty to sixty (forty-five as illustrated) degrees, via a slot 56*a* cut into both inner wall panel 22*a* (or inner wall panel 22*b*) and front wall 14 (or rear wall 16). Engaging edge 52 engages a catch of the housing shown below in FIG. 4 for example, which gradually and increasingly moves the catch as the conductive member 10 is slid into position within the housing. Eventually, engaging edge 52 slides past the catch. At this point, the catch is flexed fully. A flat tip 58 of projection 50 then engages and slides along the catch. Once tip 58 of projection 50 has slid completely past the catch, the catch snaps back into place, locking catching edge 54 of projection 50 into position with a mating surface (shown below) of the housing.

Catching edge 54 is formed at an angle, e.g., between ten and thirty (twenty as illustrated) degrees, via a slot 56*b* cut again into both inner wall panel 22*a* (or inner wall panel 22*b*) and front wall 14 (or rear wall 16). Catching edge 54 in the illustrated embodiment has a less severe angle than does engaging edge 52, such that edges 52 and 54 and tip 58 form a trapezoidal shape. Tip 58 is alternatively rounded or at least substantially pointed, such that projection 50 is more triangular than trapezoidal. In both cases, projection 50 forms a knife or lance in which the projection is angled so as to be against the direction that the conductive member 10 is moving as the member is inserted into the housing. This angle causes the projections 50 to knife up into the housing when conductive member 10 is fully assembled to prevent the conductive member from being pushed further up into the housing, e.g., upon fuse insertion into a fuse block. In the fuse example, it is desirable to maintain space between the fuse element 30 and the top of the housing for proper operation and opening of the element. Projections 50 ensure that the space between the top of the housing and fuse element 30 is maintained.

FIGS. 1 to 4 also illustrate that a third slot 56*c* is made at the bendline between front wall 14 (or rear wall 16) and outer wall 18. Slot 56*c* allows front wall 14 (or rear wall 16) and thus projection 50 to flex in a plane of the front wall 14 (or rear wall 16) in addition to the flexing of the housing catch. In this manner, once tip 58 of projection 50 has slid completely past the catch, the catch and projection 50 snapback into place, locking catching edge 54 of projection 50 into position with a mating surface (shown below) of the housing.

Referring now to FIG. 4, in one embodiment electrical component 100 is a fuse, such as a female automotive fuse. Fuse 100 includes an housing 110, which is made of a suitable electrically insulating material, such as nylon, polybutylene terephthalate ("PBT"), liquid crystal polymer ("LCP") or phenylpropanolamine ("PPA"). Housing 100 includes a catch 112, which extends from a stop 114. Conductive member 10 is inserted into housing 110 in the direction of the arrow shown in FIG. 4 prior to a cap (not illustrated) being placed onto the top of housing 110. Conductive member 10 is in the final assembled position in FIG. 4, such that a desired space is maintained between fuse element 30 and the cap when applied to housing 110. The snapped-fit engagement of projections 50 and catch 112 of housing 110 ensures that conductive member 10 does continue to slide further into the housing, compromising the space maintained between fuse element 30 and the cap (which would also slide the terminals 12*a* and 12*b* too far into housing 110).

Stops 114 engage the bottoms 14*a* and 16*a* (see also FIG. 2) of front walls 14 and rear walls 16 in the final assembled position in FIG. 4, preventing housing 110 from being removed from conductive member 10 when fuse 100 is pulled in a direction opposite the arrow (e.g., when fuse 100 is removed after fuse element 30 has opened).

Catch 112 includes a mating surface 116 and an engagement surface 118. When conductive member 10 has been inserted fully into housing 110 in the direction of the arrow of FIG. 4, engaging edge 52 of each projection 50 engages engagement surface 118 of catch 112, which gradually and increasingly bends the catch (in FIG. 4 to the left). Bendline slot 56*c* also allows the projection 50 and front wall 14 (and rear wall 16) to flex (in FIG. 4 to the right). Eventually, engaging edge 52 slides past engagement surface 118, at which point tip 58 of projection 50 engages engagement surface 118 of the catch. At this point, the catch 112 and projection 50 are flexed fully. Once tip 58 of projection 50 has slid completely past engagement surface 118 of catch 112, the catch and projection 50 snap back into place, locking catching edge 54 of projection 50 into position with mating surface 116 of the catch.

Although not seen, catch 112 including the mating surface 116 and the engagement surface 118 are repeated on the rear wall 16 side of component 100. On the rear wall side, catch 112 extends vertically down to stop 114 at the terminal body 20*b* side of housing 110 as opposed to the catch 112 extending vertically downwardly to stop 114 at the terminal body 20*a* side of housing 110 as shown from the front in FIG. 4. Such arrangement allows catch 112 to be twisted by the two projections 50 (in FIG. 4 in a clockwise rotation around the arrow) before snapping into engagement with the projections (in FIG. 4 catch 112 snaps back in a counterclockwise rotation around the arrow). In the illustrated embodiment, projections 50 are provided in opposite corners relative to housing 110.

In one alternative embodiment, catch 112 is split into separate catches, one for each projection 50. In another alternative embodiment, catch 112 is split into separate catches, one for each projection 50. In a further alternative embodiment, a projection 50 is provided for each front wall 14 and rear wall 16 of the same terminal body 20*a* or 20*b*, but for only one of the terminal bodies. In still another alternative embodiment, a projection 50 is provided for each front wall 14 and rear wall 16 of the same terminal body 20*a* or 20*b* and for both terminal bodies. In yet another alternative embodiment, only a single projection 50 is needed.

It should be appreciated that projection 50 is at least substantially coplanar with (and in the illustrated embodiment is part of the same wall as) front wall 14 or rear wall 16. In one alternative embodiment, projection 50 is welded or soldered to wall 14 or 16. Here, the weld could be a spot type weld such that the projection would not be coplanar with wall 14 or 16 but instead be abutted up against the wall, so as to be at least substantially parallel with wall 14 or 16. Given the smaller size of component 100 and the cost and precision required for such welding, however, a one-piece, coplanar projection 50 is preferred.

Figure 5:
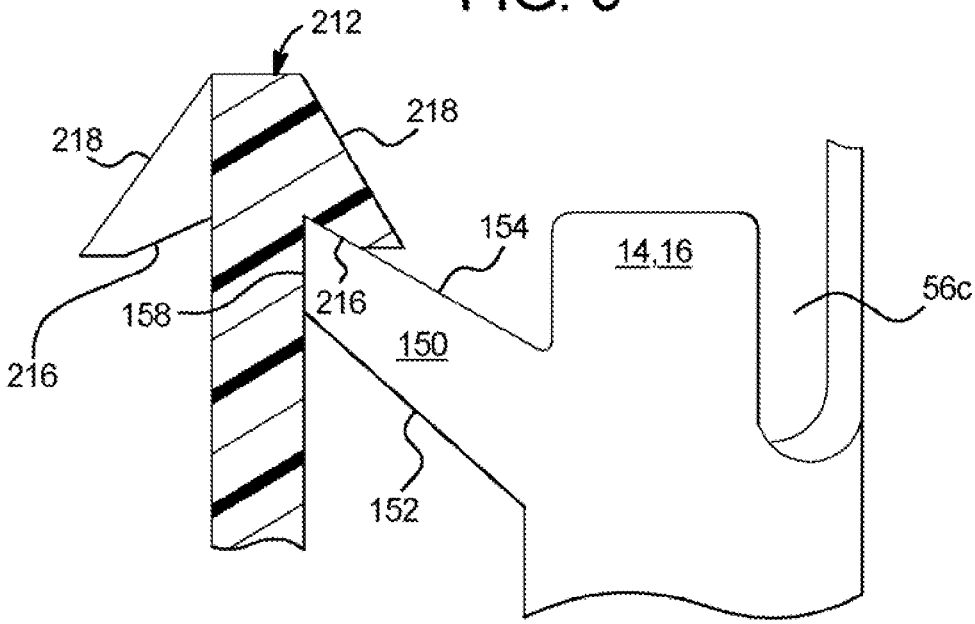
FIG. 5 is an elevation section view taken through one embodiment of an electrical component having a securing apparatus of the present disclosure, showing one alternative interaction of the projection of the conductive member and the catch of the housing.

Referring now to FIG. 5, an alternative arrangement includes projection 150 (coplanar with wall 14 or 16) and catch 212. Projection 150 is the same or similar to projection 50 and includes an engaging edge 152, a catching edge 154 and a tip 158. Wall 14 or 16 is again allowed to flex via bendline slot 56*c*. Here, catch 212 includes an engagement surface 218 that is similar to surface 118. Catch 212 includes a mating lower mating surface 216 that is angled to allow projection 150 to move up into the catch. In the illustrated embodiment lower mating surface 216 is angled to match the angle of catching edge 154, so as to allow projection 150 to move up into the catch 212 and to maximize surface area contact between the projection and the catch. A second lower mating surface 216 and a second upper engagement surface 218 (left side of catch 212 and not sectioned) are shown for the second projection 150 located on the other terminal body 120*a* or 120*b*, behind the illustrated projection 150.

Figure 6:
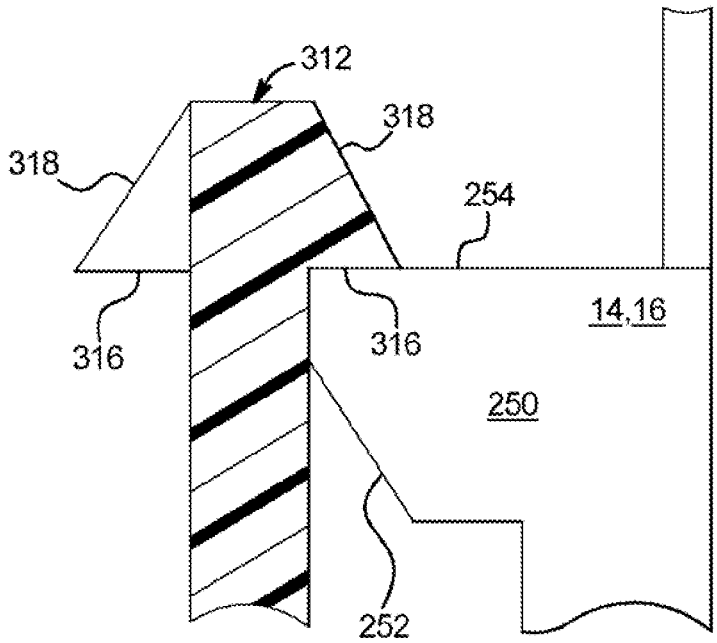
FIG. 6 is an elevation section view taken through one embodiment of an electrical component having a securing apparatus of the present disclosure, showing another alternative interaction of the projection of the conductive member and the catch of the housing.

Referring now to FIG. 6 a further alternative arrangement includes projection 250 (coplanar with wall 14 or 16) and catch 250. Here, projection 150 extends horizontally out from the top of wall 14 or 16. Notch 56*b* (FIG. 2) is not made as it is with projections 50 and 150. Mating surface 316 of alternative catch 312 is also at least substantially horizontal, so as to match the at least substantially horizontal catching edge 254 of projection 250. A second difference is that bendline slot 56*c* is not provided. Bendline slot 56*c* may not be needed for various versions of projections and catches, e.g., when the catch itself can provide the needed flexing or if a separate catch is provided for each projection.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electric component comprising:

an insulating housing;

a conductive member inserted into the housing until hitting a stop provided by the housing, the conductive member configured to mate with a conductive portion of a device that mates with the electrical component, the mating device thereby applying a force to the conductive portion, the conductive member including a first wall defining a projection that is at least substantially coplanar with the first wall, said first wall bent along a bendline from a second wall of the conductive member, a notch formed in a portion of the bendline so as to allow the projection to bend slightly as the conductive member is inserted into the housing; and wherein the housing includes a catch that flexes when the conductive member is inserted into the housing to allow the projection to move past the catch so that the conductive member can hit the stop, at which point the catch unflexes into locking engagement with the projection.

2. The electrical component if claim 1, which is of a type selected from the group consisting of: a fuse, a circuit breaker, a fuse holder and an electrical connector.

3. The electrical component of claim 1, the stop and the catch fixing the conductive member relative to the housing in an insertion direction and a direction opposite the insertion direction.

4. The electrical component of claim 1, wherein the housing is capped at a first end into which the conductive member is inserted into the housing before being capped, and open at a second end to receive the mating device.

5. The electrical component of claim 1, wherein a portion of the wall is removed to form the projection.

6. The electrical component of claim 1, where the projection has a shape that is at least one of: pointed, trapezoidal and triangular.

7. The electrical component of claim 1, wherein the projection includes an engaging edge that engages the catch as the conductive member is inserted into the housing, the engaging edge angled so as to gradually flex the catch as the conductive member moves along the catch.

8. The electrical component if claim 1, wherein the projection includes a catching edge that comes into locking engagement with the housing, the catching edge angled so as to have a directional component that opposes an insertion direction of the conductive member into the insulating housing.

9. The electrical component of claim 8, wherein the housing includes a mating surface that comes into locking engagement with the catching edge of the projection, the mating surface angled to mate with the angle of the catching edge.

10. The electrical component of claim 1, wherein the wall is a first wall and the projection is a first projection, and wherein the conductive member includes a second wall, the second wall defining a second projection that is at least substantially coplanar with the second wall.

11. The electrical component of claim 10, wherein the catch of the housing flexes when the conductive member is inserted into the housing to allow the second projection to move past the catch.

12. The electrical component of claim 10, wherein the catch is first catch, and wherein the housing includes second catch, and wherein the second catch comes into locking engagement with the second projection.

13. The electrical component of claim 10, wherein the conductive member includes first and second mating portions that mate with first and second portions of the mating device, the first wall and projection forming part of the first mating portion, the second wall and projection forming part of the second mating portion.

14. The electrical component of claim 10, wherein the first and second projections are at least one of: (i) disposed so as to be adjacent to opposing sides of the housing and (ii) disposed so as to be adjacent to diagonally spaced apart corners of the housing.

15. The electrical component of claim 10, wherein the conductive member includes first and second mating portions that mate with first and second portions of the mating device, the first wall and first projection and the second wall and second projection part of the same first or second mating portion.

16. An electric component comprising:

an insulating housing;

a conductive member inserted into the housing and configured to mate with a conductive portion of a device that mates with the electrical component, the conductive member including a first wall cut to form a projection that is at least substantially coplanar with the wall, said first wall bent along a bendline from a second wall of the conductive member, a notch formed in a portion of the bendline so as to allow the projection to bend slightly as the conductive member is inserted into the housing;

wherein the housing includes a catch that flexes when the conductive member is inserted into the housing to allow the projection to move past the catch, at which point the catch snaps into locking engagement with the projection.

17. The electrical component of claim 16, wherein the wall is cut to form the projection via a process selected from the group consisting of: (i) stamping; (ii) laser cutting; and (iii) wire electrical discharge machining ("EDM").

18. The electrical component of claim 16, the locking engagement of the projection and the catch preventing movement of the conductive member relative to the housing in a first direction, the housing further providing a stop that prevents movement of the conductive member relative to the housing in a second direction.

* * * * *